US005346314A

United States Patent [19]

Perratone et al.

[11] Patent Number: 5,346,314

[45] Date of Patent: Sep. 13, 1994

[54] BEARING ASSEMBLY AND VESSEL TURRET ASSEMBLY

[75] Inventors: René Perratone; Yves Tosetti, both of Menton, France

[73] Assignee: Single Buoy Moorings, Inc., Marly, Switzerland

[21] Appl. No.: 6,996

[22] Filed: Jan. 21, 1993

[51] Int. Cl.[5] ..... B63B 21/00

[52] U.S. Cl. ..... 384/97; 114/230

[58] Field of Search ..... 384/97, 276, 247, 295, 384/428; 114/230, 294; 441/3-5

[56] References Cited

U.S. PATENT DOCUMENTS 4,606,727 8/1986 Koenig et al. ..... 441/5
4,660,494 4/1987 Doré et al. ..... 114/230
5,025,742 6/1991 Urdshals ..... 114/230
5,065,689 11/1991 Krugstad ..... 114/230
5,170,737 12/1992 Poldervaart ..... 114/230 X
5,178,087 1/1993 O'nion et al. ..... 114/230

*Primary Examiner*—Thomas R. Hannon
*Attorney, Agent, or Firm*—Young & Thompson

[57] ABSTRACT

A bearing assembly comprises one side exposed to a fluid and the other side to a dry area or compartment(s) which can be emptied. To replace part(s) of the bearing assembly a compartment is located in the compartment(s) through which a section of the bearing is guided. After a part of the bearing section has been moved backwards the compartment can be closed via a valve, then the bearing section can be removed completely from the cavity thus preventing considerable quantities of fluid from entering the compartment(s). This bearing structure can be used in a vessel turret assembly.

11 Claims, 2 Drawing Sheets

BEARING ASSEMBLY AND VESSEL TURRET ASSEMBLY

BACKGROUND OF THE INVENTION

The subject invention relates to a bearing assembly having at least a section of which one side is exposed to a first condition and the other side to a second condition. Such bearing assemblies are Generally known in the art and e.g. used below water level. E.g. such bearing assemblies are used in vessel turret structures, wherein the vessel is provided with an internal shaft extending from the deck of the vessel to the bottom of the hull for receiving a turret structure. To obtain optimum journaling of the turret relative to the vessel, the bearings are positioned as far away from each other as possible. This means that one bearing is provided near the deck of the vessel whilst the other bearing is provided near the bottom of the hull of the vessel. Whilst the upper bearing functions under relatively favourable conditions the lower bearing is exposed to the influence of (salt) water. This means that it is subjected to considerable wear and tear. To this end it is proposed to use a bearing pad which can be adjusted afterwards to take up any wear. However, if the bearing pad is used it has to be replaced. The bearing pad is adjusted from the wall of the shaft of the vessel and to replace the bearing pad, it is necessary to remove it to the internals of the vessel. This means that an open communication is realized between the surrounding water and the internals of the vessel. Except from safety point of view it will be clear that it is quite inconvenient to replace such a bearing because this has to be done in a submerged condition and divers are necessary to replace the bearing pad inside the hull of the vessel.

The invention aims to obviate these drawbacks and to provide a bearing assembly of which at least one part can be removed without taking any further special precautions or complicated steps.

SUMMARY OF THE INVENTION:

According to the invention a bearing assembly is provided having at least a section of which one side is exposed to a first condition and the other side to a second condition, wherein on the other side a compartment is provided which can receive said section, wherein said section is displaceable between a first position in which it acts as a part of the bearing and a second position in which it can be exchanged, wherein said compartment is provided with valve means to isolate the compartment together with the section in its second position from the first condition.

The first condition comprises preferably sea water and the second condition a dry area.

According to a further aspect of the invention a bearing assembly is provided to be used below water level, comprising a harder bearing face and a softer bearing face to be positioned against each other, the softer bearing face comprising a bearing pad being adjustably arranged, to take up wear, in a support, connected to a structure, one side of the structure being exposed to the water and the other side of the structure being isolated from the water, the improvement comprising that the support is arranged in a compartment in the structure, the compartment opening to the bearing face through a valve to isolate the compartment from the water and wherein means are provided to remove the pad from the compartment if the valve is closed.

According to the invention a cavity having a valve is provided which acts as intermediate between the internals of the structure such as a hull and the surrounding water.

Preferably, this compartment is at least partially cylindrical and the support comprises a piston sealingly engaged in the cylinder. One extremity of the piston is provided with the pad. It is possible to move the piston in the cylinder and as long as the piston engages the cylinder near its sealing faces there is no danger that water will enter the structure. After the piston with the pad as moved beyond the valve it is possible to close the part of the cylinder in open communication with the water after which the piston can be further retracted inside the structure and the pad can be replaced. Preferably, sealing comprises a ring sealing arranged near the extremity of the piston adjacent to the bearing pad. In this way the length of the cylinder can be kept as short as possible.

Preferably, the pad comprises a bronze based material having good wearing properties and corrosion properties in the presence of salt water.

Preferably but not exclusively, the invention is used in a vessel turret assembly.

BRIEF OF DESCRIPTION OF THE DRAWINGS

FIG. 1 shows the front part of a vessel provided with a turret assembly in cross section; and FIG. 2 shows on a larger scale partially in cross section detail II of FIG. 1.

DETAILED DESCRIPTION OF A PREFERRED EMBODIMENT

Figure 1:
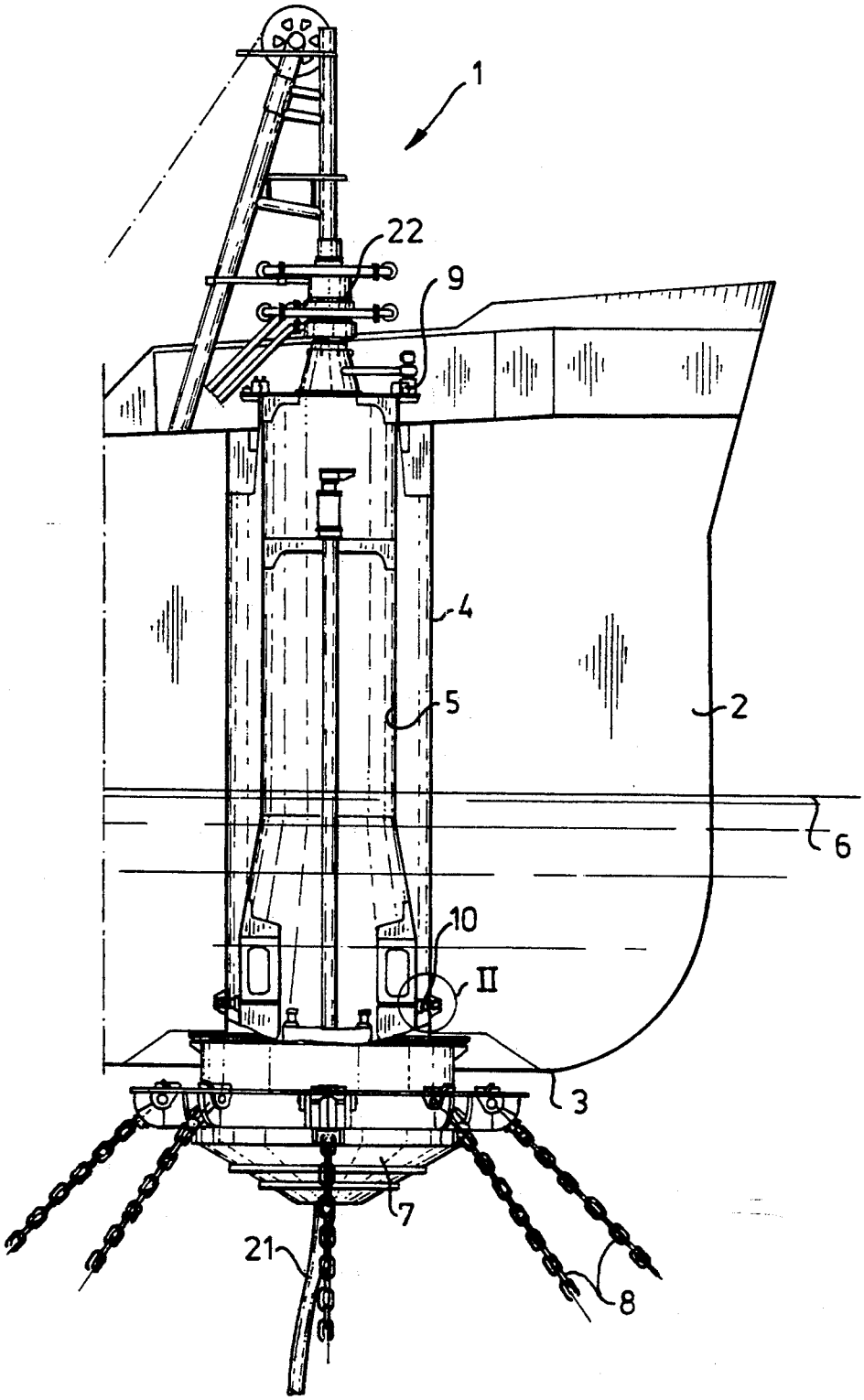

Referring to the drawings in FIG. 1 a vessel is generally indicated with 1. Its hull is given the reference 2 while the bottom is indicated with 3. A shaft 4 extends from the deck of the vessel to the bottom 3 and inside this shaft 4 a turret 5 is provided. This turret 5 is rotatably arranged in the shaft through bearings 9 and 10. The lower part 7 of the turret is disconnectable from the part of the turret being inside the vessel. This lower part 1 is connected through anchor lines 8 with the sea bottom and line 21 extends to the sea bottom to an underwater oil well or the like. Oil coming from line 21 is transported through the turret to swivel 22 to the deck of the vessel and either pumped in the vessel or conveyed to another vessel. Whilst the turret is in a fixed rotational position relative to the sea bottom vessel 2 can rotate around the turret dependent from the wind and sea conditions. If it is expected that these conditions become very severe, lower part 7 of the turret is disconnected from turret structure 5.

Whilst upper bearing 9 is in relatively dry condition, lower bearing 10 is subjected to the influence of sea water because the sea water extends below level 6. To make journaling of the turret as rigid as possible bearings 9 and 10 are spaced apart as much as possible.

Figure 2:
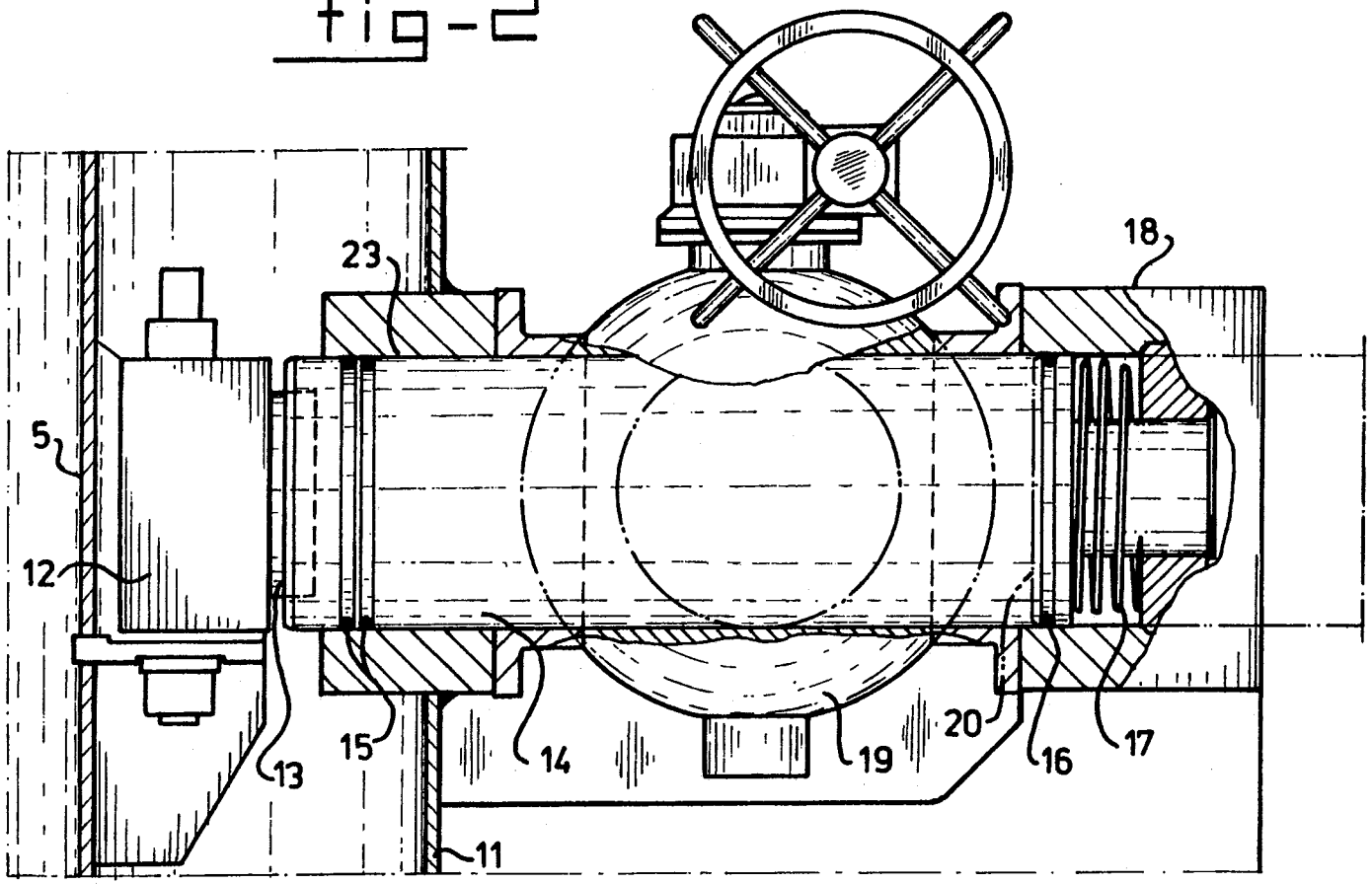

As is clear from FIG. 2 which shows on a larger scale detail II of FIG. 1 bearing assembly 10 ~~comprises a~~ pad 13 engaging against the bearing part 12 of the turrets. Materials of parts 12 and 13 are chosen such that part 12 will be subjected to relatively minor wear and tear, while part 13 is subjected to major wear. To this end pad 13 is made of a bronze based material. Pad 13 is received in an adjustable piston 14 and through pressure spring 17 this piston 14 is together with pad 13 urged to the left in FIG. 2 such that even after a part of pad 13 is removed from its upper surface constant contact of pad 13 against bearing 12 of the turret is guaranteed. Piston 14 is received in cylindrical duct 23 which is connected to wall 11. Piston 14 is provided with O-ring sealings 15, 16 respectively. O-ring sealings 15 are near the water end of cylindrical duct 23. In cylindrical duct 23 valve 19 is provided. Duct 23 is sealed at its other extremity by an end closure 18.

As indicated above, the piston pressure spring assembly is able to take up wear of pad 13 and to adjust the bearing assembly. However, if pad 13 has been used it is necessary to replace this pad. To that end, end closure 18 is removed and piston 14 is displaced to the right in FIG. 2 to the dotted line position 20. Because of the presence of O-ring sealings 15 engaging the wall of duct 23 entering of water in hull 2 of the vessel is prevented. If the piston is in the dotted position 20 valve 19 is closed. Valve 19 can be any valve known in the art, such as a ball valve or a disc valve. After closing valve 19 the piston 14 can be removed from duct 23 together with used pad 13. Only a very minor quantity of water, being the volume of water present between the front part of pad 13 and valve 19 will enter the hull. Pad 13 can be replaced and piston 14 together with the new pad can be reintroduced in duct 23. After that valve 19 can be opened and the piston can be moved to the initial position shown in FIG. 2 after which the valve assembly can be used to support the turret.

It is clear that by the simple provision of a valve replacement of the bearing pad 13 can be considerably improved.

Although the invention is elucidated referring to a vessel turret assembly it has to be understood that it can be used with any bearing assembly which has to be used under water or under other conditions wherein on one side of the support a first condition exists whilst on the other side a second condition is present which have to be isolated from each other as much as possible.

We claim:

1. Bearing assembly having at least a section of which one side is exposed to a first condition and the other side to a second condition, wherein on the other side a compartment is provided which can receive said section, wherein said section is displaceable between a first position in which it acts as a part of the bearing and a second position in which it can be exchanged, wherein said compartment is provided with valve means to isolate the compartment together with the section in its second position from said first condition.

2. Bearing assembly according to claim 1, wherein said first condition comprises sea water and said second condition a dry area.

3. Bearing assembly according to claim 1, further comprising a support arranged in the compartment, said compartment comprising a cylinder and said support including a piston sealingly engaged in said cylinder, said piston having a bearing pad provided on one extremity, and wherein the sealing of the piston comprises a ring sealing provided near the extremity of the piston adjacent to the bearing pad.

4. Bearing assembly according to claim 3, wherein the bearing pad comprises a bronze based material.

5. Bearing assembly to be used below water level, comprising a harder bearing face and a softer bearing face to be positioned against each other, the softer bearing face comprising a bearing pad being adjustably arranged, to take up wear, in a support, connected to a structure, one side of the structure being exposed to the water and the other side of the structure being isolated for the water, the improvement comprising that said support is arranged in a compartment in said structure, said compartment opening to the bearing face through a valve to isolate the compartment from the water and wherein means are provided to remove the pad from the compartment if the valve is closed.

6. Bearing assembly according to claim 5, wherein the compartment comprises a cylinder and the support comprises a piston sealingly engaged in said cylinder and wherein on one extremity of said piston the bearing pad is provided.

7. Bearing assembly according to claim 6, wherein the sealing of the piston comprises a ring sealing provided near the extremity of the piston adjacent to the bearing pad.

8. Bearing assembly according to claim 5, wherein the wearing pad comprises a bronze based material.

9. Vessel turret assembly, wherein the vessel is provided with an internal shaft extending from the deck of said vessel to the bottom of the hull, for receiving a turret structure having a bearing assembly near the upper and lower part of the shaft, the bearing assembly near the lower part comprising a pad fixed relative to the wall of said shaft to slidingly engage the turret structure, said pad being connected to a sealingly displaceable piston received in a duct connected to said shaft, wherein a valve is arranged in said duct.

10. Vessel turret assembly according to claim 9, wherein the sealing of the piston comprises a ring sealingly provided near the extremity of the piston adjacent to the bearing pad.

11. Vessel turret assembly according to claim 10, wherein the bearing pad comprises a bronze based material.

* * * * *